US006263570B1

(12) United States Patent
Cazacu

(10) Patent No.: US 6,263,570 B1
(45) **Date of Patent: *Jul. 24, 2001**

(54) HEAT EXCHANGER AND METHOD OF PRODUCING THE SAME

(75) Inventor: Daniela Cazacu, Solvesborg (SE)

(73) Assignee: Valeo Engine Cooling Aktiebolag (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/826,471

(22) Filed: Mar. 27, 1997

(30) Foreign Application Priority Data

Mar. 29, 1996 (SE) ..... 9601207

(51) Int. Cl.[7] ..... B21D 39/06; B21D 53/08

(52) U.S. Cl. ..... 29/890.043; 29/890.054; 165/173; 165/178; 285/222

(58) Field of Search ..... 165/153, 173, 165/178, 79, 175; 285/222, 201, 202, 203; 29/890.043, 890.054

(56) References Cited

U.S. PATENT DOCUMENTS

| | | | | |
|---|---|---|---|---|
| 604,664 | * | 5/1898 | Koelkebeck et al. | 285/222 X |
| 1,988,418 | * | 1/1935 | German | 285/222 |
| 2,573,161 | | 10/1951 | Tadewald . | |
| 4,456,059 | | 6/1984 | Cadars . | |
| 4,546,824 | | 10/1985 | Melnyk . | |
| 4,749,033 | * | 6/1988 | Clausen | 165/173 |
| 5,211,221 | * | 5/1993 | Lease | 165/79 X |
| 5,219,024 | | 6/1993 | Potier | 165/173 |
| 5,228,512 | * | 7/1993 | Bretl et al. | 165/153 |
| 5,314,021 | | 5/1994 | Potier . | |
| 5,381,858 | * | 1/1995 | Fredrich | 165/79 |
| 5,918,667 | * | 7/1999 | Chiba et al. | 165/178 |

FOREIGN PATENT DOCUMENTS

| | | | | |
|---|---|---|---|---|
| 2813951 | * | 10/1979 | (DE) | 165/178 |
| 4432972 | * | 4/1995 | (DE) | 165/175 |
| 379.701 | | 12/1989 | (EP) . | |
| 590.945 | | 4/1994 | (EP) . | |
| 457978 | | 1/1995 | (EP) . | |
| 781.792 | | 5/1935 | (FR) . | |
| 1.232.414 | | 5/1971 | (GB) . | |
| 1.477.323 | | 6/1977 | (GB) | 165/175 |

* cited by examiner

*Primary Examiner*—Leonard Leo
(74) *Attorney, Agent, or Firm*—Morgan & Finnegan, LLP

(57) ABSTRACT

A heat exchanger for vehicles comprises firstly a heat-exchanger assembly consisting of flat liquid-conveying tubes and surface-enlarging means, secondly an inlet tank, and thirdly an outlet tank. The inlet tank and the outlet tank have a connection plate with a number of connection holes for the tubes. At each hole, the plate has a projecting connecting sleeve element. Each tube has at its ends a widened main portion which is accommodated on said connecting sleeve element. A rounded transitional area is formed between the connection plate and each connecting sleeve element, and the main portion is inserted in the conecting sleeve element and is applied with its outside against the inside of the connecting sleeve element. Each tube has at its ends an end portion which is widened in relation to the main portion, merges with the main portion and is applied against the transitional area. In a method of producing such a heat exchanger, the widened end area of the tubes are inserted in the connecting sleeve elements and are widened further in such a manner that each tube end is applied against the transitional area between the plate and the respective connecting sleeve element.

5 Claims, 5 Drawing Sheets

HEAT EXCHANGER AND METHOD OF PRODUCING THE SAME

FIELD OF THE INVENTION

The present invention relates to a heat exchanger, in particular a water or air radiator for a vehicle, and the like. More particularly, the invention also relates to a method of producing the same.

PRIOR ART

A common area of application for heat exchangers is cooling of circulating liquids in motor vehicles and machine tools, e.g. the liquid which cools the engine block. Heat exchangers are also used, for example, for cooling the intake air which is to be combusted in the engine of the vehicle.

A vehicle radiator is known through Swedish patent 9202819. The radiator is made of aluminum and has a heat-exchanger assembly which consists of surface-enlarging means and two rows of flat liquid-conveying tubes which are arranged flat side to flat side in the respective row. The surface-enlarging means are arranged between each pair of tubes in the respective row and are intended to guide an air flow through the heat-exchanger assembly in the transverse direction of the tube rows. The radiator also has an inlet tank, which is connected to a first end of the heat-exchanger assembly, and an outlet tank which is connected to the second end of the heat-exchanger assembly. The inlet tank and the outlet tank have a connection plate which is provided with a number of holes and which has, at each hole, a connecting sleeve element projecting from the tank. Each tube end has a widened portion which is accommodated on a connecting sleeve element and the inside of which is applied against the outside of the connecting sleeve element. When the tubes are mounted on the respective connection plate, the widened tube portions are thus guided over the connecting sleeve elements of the plate. The tubes are then connected to the connection plate by brazing. For brazing, external fixtures are required, for reasons which are explained below.

The production takes place by the parts, which have an external solder layer, being assembled, fixed to one another and subsequently placed in a furnace with a protective gas atmosphere or in a vacuum furnace. The soldering takes place by the external material layer on each component melting and forming solder material. This brazing is preferably carried out in one stage, that is to say the heat exchanger is assembled and soldered together subsequently in the furnace.

The soldering process requires the parts to be applied properly against one another and to be fixed in position. Since the parts of the heat exchanger are loose in relation to one another before the soldering process, use is today made of external fixtures. These are expensive, however, and moreover conduct heat away from those parts which are to be soldered together. Furthermore, it is a time-consuming process to fix the parts of the heat exchanger with great accuracy using external fixtures, which makes the production more expensive.

In the production of radiators of the above type, it has emerged that, in spite of the use of external fixtures, a large number of radiators leak, after brazing, at the joints between the tubes and the connecting sleeve elements, as a result of which up to approximately 20% of radiators have had to be rejected, since the leakage detected cannot be repaired manually after brazing.

Furthermore, the connecting sleeve elements can cause turbulence and retard liquid flow through the tubes.

The prior art also includes EP-B-0 457 978 which discloses a heat exchanger with connection plates and flat liquid-conveying tubes.

OBJECTS OF THE INVENTION

A general object of the present invention is to completely or at least essentially overcome the problems of the prior art described above. More specifically, one object of the invention is to produce a heat exchanger with a low rejection rate in production.

One particular object of the invention is to produce a heat exchanger which can be soldered together without the need for external fixtures.

Another object is to produce a heat exchanger which can be assembled for soldering in one stage in a rapid, simple, very accurate manner with low requirements on the tolerances of the individual parts.

A further object of the invention is to produce a heat exchanger which allows manual repair of leaking joints after it has been soldered together.

It is likewise an object to produce a heat exchanger having reduced risk of generating turbulence in the transition between tube and tank.

It is also an object of the invention to indicate a production method which solves the abovementioned problems.

SUMMARY OF THE INVENTION

According to one aspect of the invention there is provided a heat exchanger for vehicles, comprising a heat-exchanger assembly, which includes at least one row of spaced-apart flat liquid-conveying tubes as well as surface-enlarging means arranged between the tubes in the respective rows. An inlet tank is connected to a first end of the heat-exchanger assembly, and an outlet tank connected to a second end of the heat-exchanger assembly. The inlet and the outlet tanks have having a connection plate, which is formed with a number of connection holes for the tubes and which, at each hole, is provided with a connecting sleeve element projecting from the tank. Each tube has at its ends, a widened main portion accommodated on the connecting sleeve element. A rounded transitional area is provided between the connection plate and the respective connecting sleeve elements. The main portion is inserted in the connecting sleeve element with its outside, circumferentially applied against the inside of the element. Each tube at its ends has an end portion which is widened in relation to the main portion and which merges with the main portion and is applied against the transitional area.

According to a further aspect of the invention there is provided a method of connecting flat liquid-conveying tubes to a connection plate in the production of a heat exchanger. A plurality of holes are formed in the connection plate and are deformed in such a manner that tube-accommodating connecting sleeve elements are formed on the one flat side of the plate. One end area of each tube is, in a first step of deformation, deformed in such a manner as to obtain a shape corresponding to that of the connecting sleeve element, thereby increasing the cross-sectional area of the end area. The end area is, in the first step of deformation, given smaller dimensions than the connecting sleeve element. The widened end areas of the tubes are, from the one flat side, inserted in the connecting sleeve elements until the end surfaces of the tubes are located essentially on a level with the holes of the plate. The widened end areas of the tubes are, in a second step of deformation, further widened from the other flat side of the plate in such a manner that the respective tube ends are applied against a transitional area located between the plate and the respective connecting sleeve elements.

The method according to the invention reduces the risk of leakage in the heat exchanger produced, as a solder layer is applied to a solder layer in the joints between the connecting sleeve elements and the tubes. As a result, the quantity of solder material which is available during brazing is increased.

Moreover, during assembly of the heat exchanger, relatively large tolerances of the individual parts, such as the tubes and the connection plates, are allowed as the concluding, second deformation step evens out mutual size variations.

Mounting of a tube on the connection plate is facilitated also by the widened main portion of the tube being inserted into the connecting sleeve element and thus being guided against the inside thereof.

The parts included in the heat-exchanger assembly are interconnected due to the concluding, second deformation step, and external fixtures can therefore be dispensed with.

The joints between the tubes and the connection plate are accessible from the flat side of the plate facing away from the tubes. In the event that, after brazing, it emerges that one or more joints are not sufficiently tight, these can consequently be repaired by manual soldering.

The inside of the tube is completely smooth at the transition between the tube and the tank, which minimizes the occurrence of turbulence.

BRIEF DESCRIPTION OF THE DRAWINGS

The invention and its advantages will now be described for the purpose of exemplification with reference to the attached, diagrammatic drawings which illustrate a currently preferred embodiment and in which.

DESCRIPTION OF PREFERRED EMBODIMENTS

Figure 1:
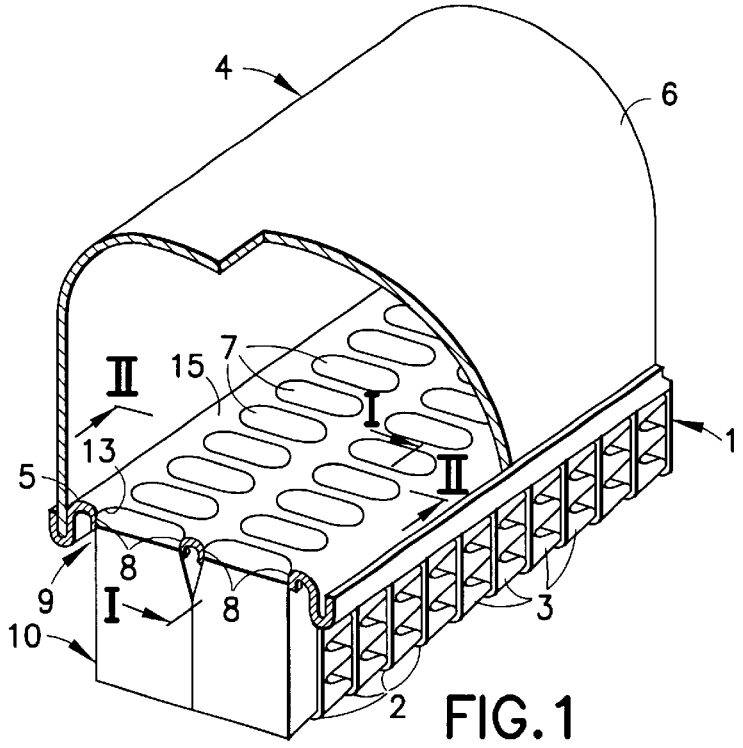
FIG. 1 is a perspective view of a part of a heat exchanger according to the present invention, certain parts being cut away for the sake of clarity.

The heat exchanger according to FIG. 1 has a heat-exchanger assembly 1 with two essentially parallel rows of flat liquid-conveying tubes 2 made of aluminum. The heat-exchanger assembly 1 also has surface-enlarging means 3, so-called ranks, which extend over the width of the heat-exchanger assembly 1 and which are arranged between each pair of tubes 2 in the respective row. The tubes 2 are arranged flat side to flat side in each row. An inlet tank 4, which comprises a connection plate 5 made of aluminum and a cover 6 connected to the plate 5, is connected to a first end of the heat-exchanger assembly 1. A corresponding outlet tank (not shown) is connected to the second, opposite end of the heat-exchanger assembly 1. The fastening of the cover 6 to the plate 5 is not significant for the invention and is not described any further.

The connection plate 5 is provided with parallel first and second rows of oblong holes 7 which, in the transverse and longitudinal directions, are situated at a distance from one another and to which the tubes 2 are connected. The plate 5 has connecting sleeve elements 8 which are formed in one piece with and project from the flat side of the plate 5 facing away from the tank 4 and also surround the holes 7.

Figure 2A:
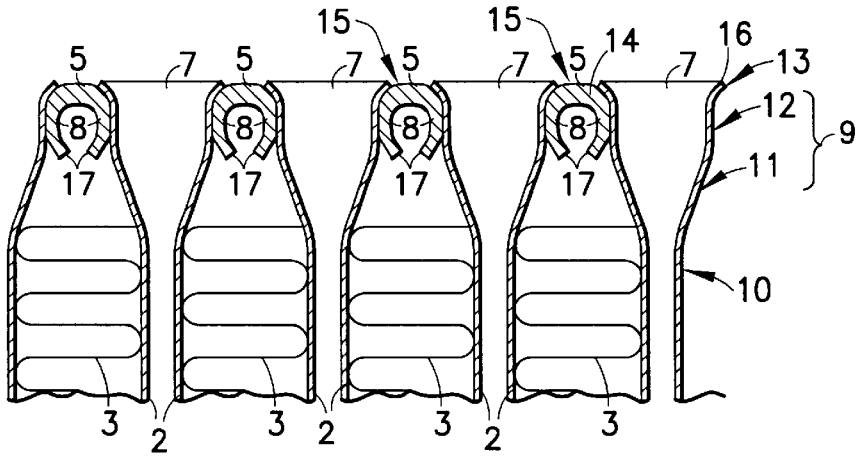
FIG. 2*a* is a part of a longitudinal cross-sectional view along the line I—I in FIG. 1.
Figure 2B:
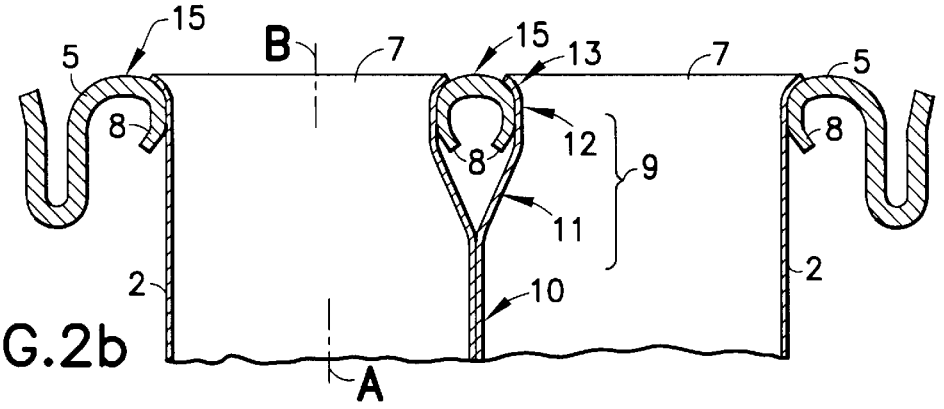
FIG. 2*b* is a transverse cross-sectional view along the line II—II in FIG. 1.

From FIGS. 2*a* and 2*b*, it can be seen that each tube 2 has a widened main portion 9 at its respective ends. Between the widened main portions 9, the tube 2 has a tube body 10. The widened main portion 9 comprises on the one hand a funnel-shaped part 11, which merges with the tube body 10, and on the other hand a straight cylindrical part 12 which merges with the funnel-shaped part 11 and is applied with its outside circumferentially against the inside of the connecting sleeve element 8. The main portion 9 then has a further widened end portion 13 which is applied against a rounded transitional area 14 between the connecting sleeve element 8 and the top side of the connection plate 5. The widened end portion 13 of the tube 2 has the shape of a truncated cone and extends as far as the inner bottom surface of the tank 4, that is to say as far as the flat side 15 of the plate 5 facing away from the tubes 2, so that the end edge 16 of the tube 2 is situated essentially on a level with this flat side 15.

Each tube 2 has a symmetry plane in the longitudinal direction of the tube rows. Different parts of the tube 2 have different symmetry planes, which will be further explained below. The symmetry plane of the tube body 10 which lies between the widened main portions 9 is designated by A in FIG. 2*b*, while the symmetry plane of the main portion 9 itself is designated by B.

It can be seen from FIGS. 1 and 2*b* that the tubes 2 in one row are applied against the tubes in the second row along essentially the entire tube body 10. Preferably, the tubes 2 are soldered together in this contact portion in order to constitute a further improvement of the stability and strength of the construction.

In order to achieve this contact, the widened main portion 9 is positioned asymmetrically in relation to the tube body 10 by the symmetry plane B of the main portion 9 being set off in relation to the symmetry plane A of the tube body 10, and more specifically set off in the transverse direction of the tube rows away from the tube row against which the tube body 10 is applied.

In the production of a heat exchanger according to the invention, holes 7 are formed in the connection plate 5, e.g. by punching in one or, depending on the thickness of the plate 5, a number of steps. The plate 5 is then placed with one flat side against a pad (not shown). Subsequently, a punch (not shown) is applied against the holes 7 from the other flat side 15 of the plate 5, as a result of which the holes 7 assume their final, oblong shape and the collars or connecting sleeve elements 8 surrounding the holes 7 are formed.

Then, in a first deformation step, the tube 2, which originally has a uniform cross-section, is flared out in such a manner that the shape of its end area widened main portion 9 and further widened end portion 13 that is to say the area which subsequently forms the abovementioned main portion 9 and end portion 13, essentially corresponds to, but is smaller than, the shape of the connecting sleeve element 8 and the hole 7. During this flaring, the width of the narrow sides of the flat tube 2 is increased at the same time as the width of the flat sides of the tube 2 is decreased. Overall, the flaring leads to a greater cross-sectional area in the end area or widened main portion 9, and further widened end portion 13 than in the tube body 10, which gives a reduced pressure drop in the liquid flowing through at the transition between the tube 2 and the tank 4.

The flaring also includes a step in which one narrow side of the tube 2 is fixed, whereupon its other narrow side is pressed towards the fixed narrow side in order to bring about the abovementioned asymmetry between the tube body 10 and the end area that has the widened main portion 9 and the further widened end portion 13 of the tube 2.

Subsequently, these widened end area 9, 13 of the tube 2 are inserted in the connecting sleeve element 8 from the flat side of the plate 5 provided with connecting sleeve elements. The tube 2 is inserted only until its end surface is situated on a level with the hole 7.

Then, in a second deformation step, a punch (not shown) with the shape of the further widened end portion 13 is introduced from the flat side 15 of the plate 5 into the tube end situated in the hole 7 for expansion of the end area or portions 9, 13 of the tube 2 in the hole 7 to the extent that the outside of the tubular or cylindrical part 12 is applied against the inside of the connecting sleeve element 8 and the end of the tube 2 is applied against the transitional area 14 between the plate 5 and the connecting sleeve element 8. The end of the tube 2 hereby takes on the shape of a truncated cone.

According to a preferred embodiment, before the tube 2 is introduced into the connecting sleeve element 8, the end portion 17 of the connecting sleeve element 8 facing away from the plate 5 has been widened by means of a punch (not shown). This widening facilitates the subsequent introduction of the widened end area or portions 9, 13 of the tube 2.

It is to be emphasized that the aluminum tubes 2 normally have a solder layer only on their outside, while the plate 5 has solder material at least on its flat side 15 facing away from the tube. The production method according to the invention consequently leads to an increased quantity of solder material in the joint between the tubes 2 and the plate 5 as the solder layer of the tubes 2 is applied to the solder layer of the connecting sleeve elements 8. This is particularly important when flared end areas are used, as the flaring leads to a reduced wall thickness of the tube 2 and therefore a reduced solder layer thickness also.

FIGS. 3–5 show three further embodiments of the present invention, identical parts having been provided with the same references and not being further described below.

Figure 3A:
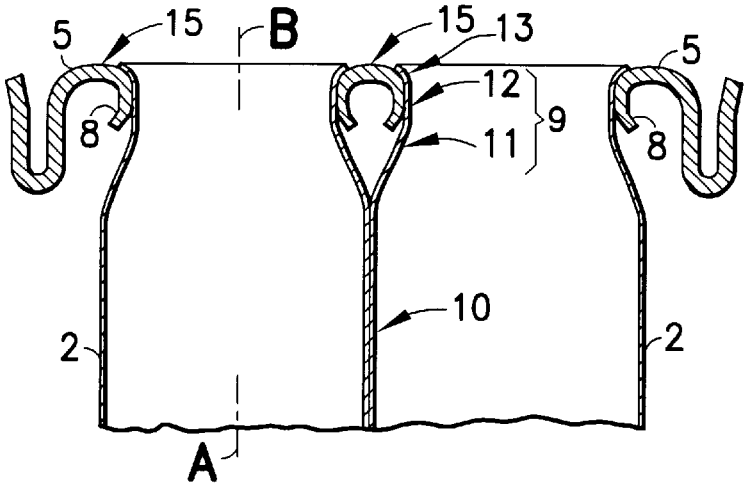
FIGS. 3*a* and 3*b* are views corresponding to FIGS. 2*b* and 2*c* respectively of another embodiment of the present invention.

The heat exchanger according to FIG. 3*a* has liquid-conveying tubes 2 of which the widened main portions 9 are positioned symmetrically in relation to the tube bodies 10, that is to say the symmetry plane B of the main portion 9 coincides with the symmetry plane A of the tube body 10. Thanks to the symmetry, this type of heat exchanger is easier to assemble but has lower efficiency than a heat exchanger with asymmetrical tubes for the following reason.

Figure 2C:
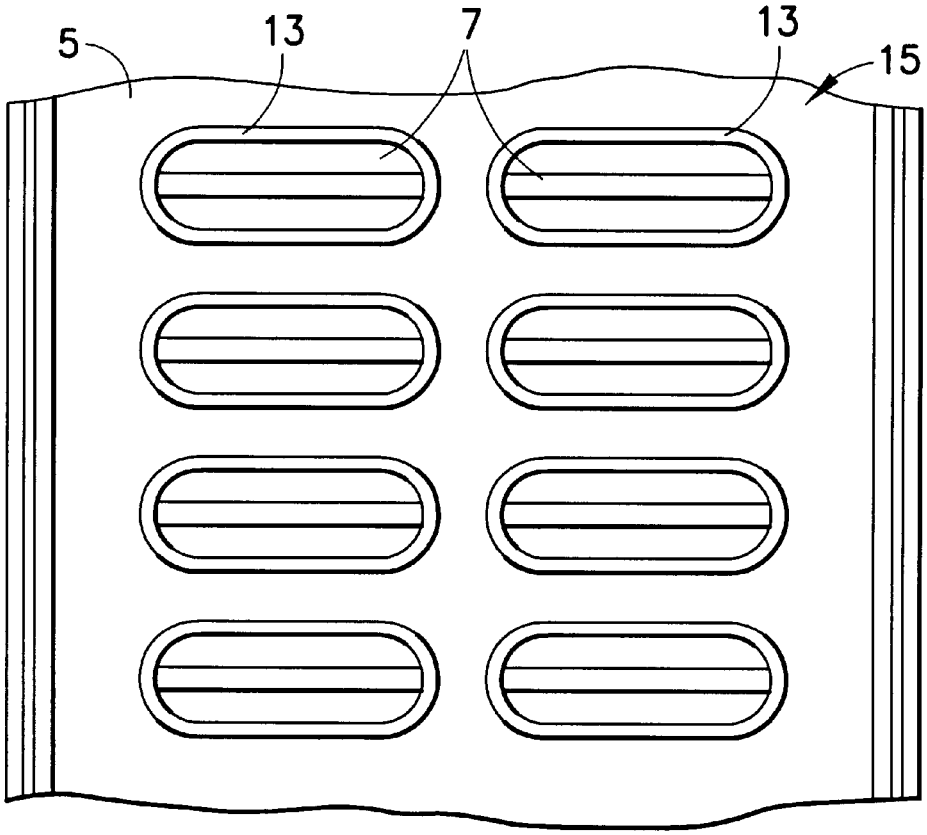
FIG. 2*c* is a plan view of a connection plate with liquid-conveying tubes mounted.
Figure 3B:
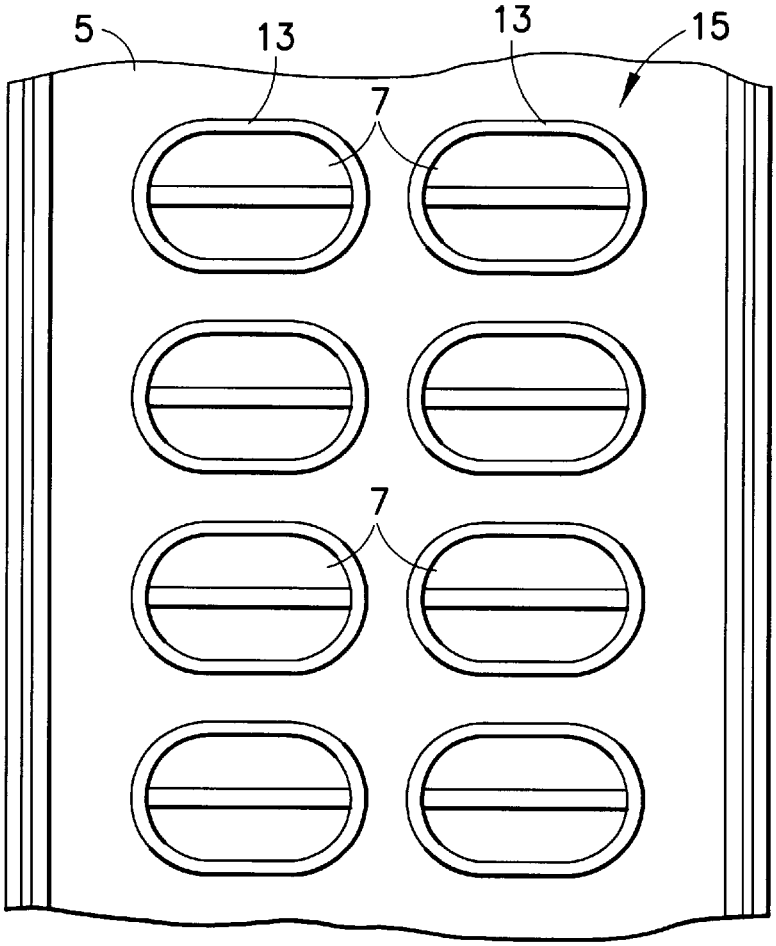

It applies generally that, after the flaring of the end area 9, 13 of the tube 2, the main portion 9 of the tube 2 will have essentially the same circumference as the tube body 10. For manufacturing reasons, the distance between the connecting sleeve elements 8 on the connection plate 5 cannot be made as small as desired. In order to achieve the preferred contact between the tube bodies 10, the main portion 9 must therefore be made shorter and wider than is the case in the abovementioned asymmetrical design. This emerges clearly if the plan view in FIG. 3*b* is compared with the plan view in FIG. 2*c*. The asymmetrical design according to FIGS. 1 and 2 is advantageous because it means that the tubes 2 can be arranged closer to one another in the longitudinal direction of the tube rows. The use of asymmetrical tubes 2 therefore provides a more efficient heat exchanger as more tubes 2 can be accommodated on a given connection plate 5.

Figure 4A:
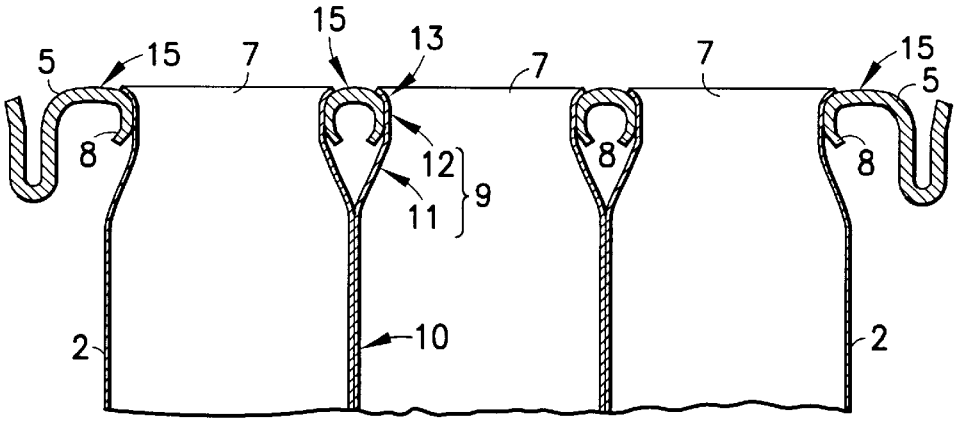
FIGS. 4*a* and 4*b* are views corresponding to FIGS. 3*a* and 3*b* respectively of a further embodiment.
Figure 4B:
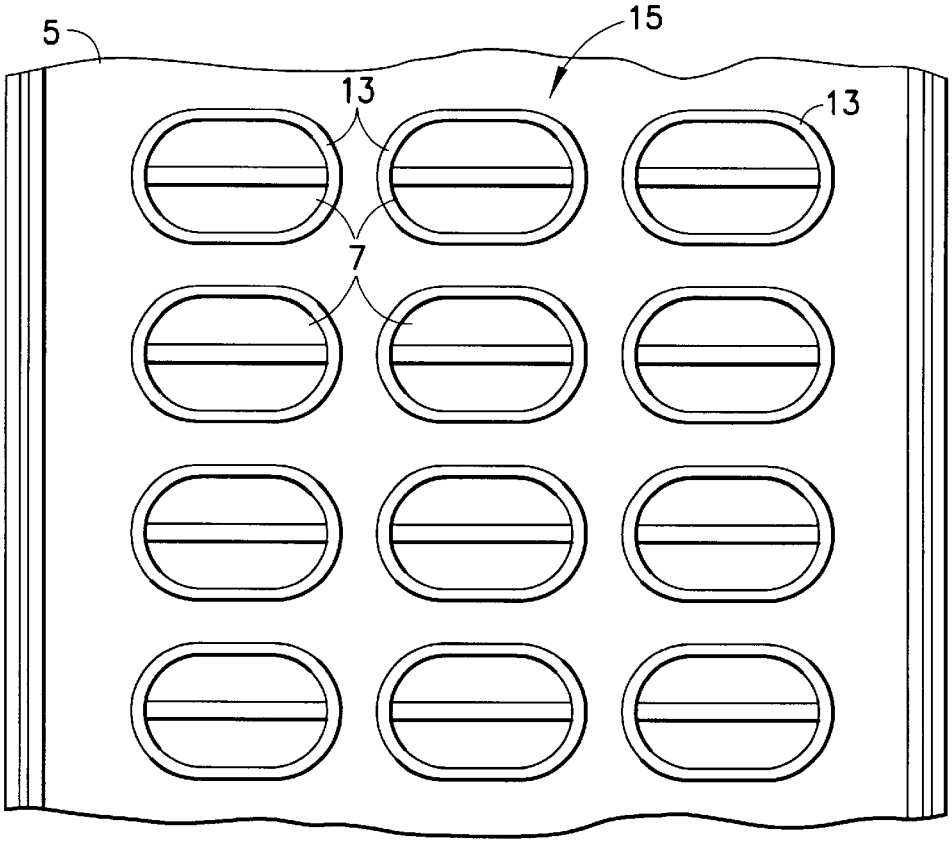

FIGS. 4*a*–4*b* show a further example of a heat exchanger according to the invention. The heat exchanger has three rows of liquid-conveying tubes 2, the main portions 9 of the tubes being positioned symmetrically in relation to the tube bodies 10. In this case also, the tubes 2 and the connecting sleeve elements 8 are designed in such a manner that the tubes 2 in one row are applied against the tubes 2 in adjacent rows over essentially the entire tube body 10, which gives the construction good stability.

Figure 5A:
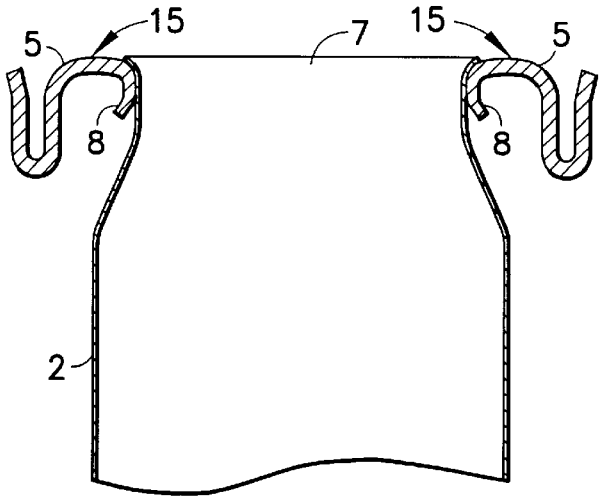
FIGS. 5*a* and 5*b* are corresponding views of yet another embodiment.
Figure 5B:
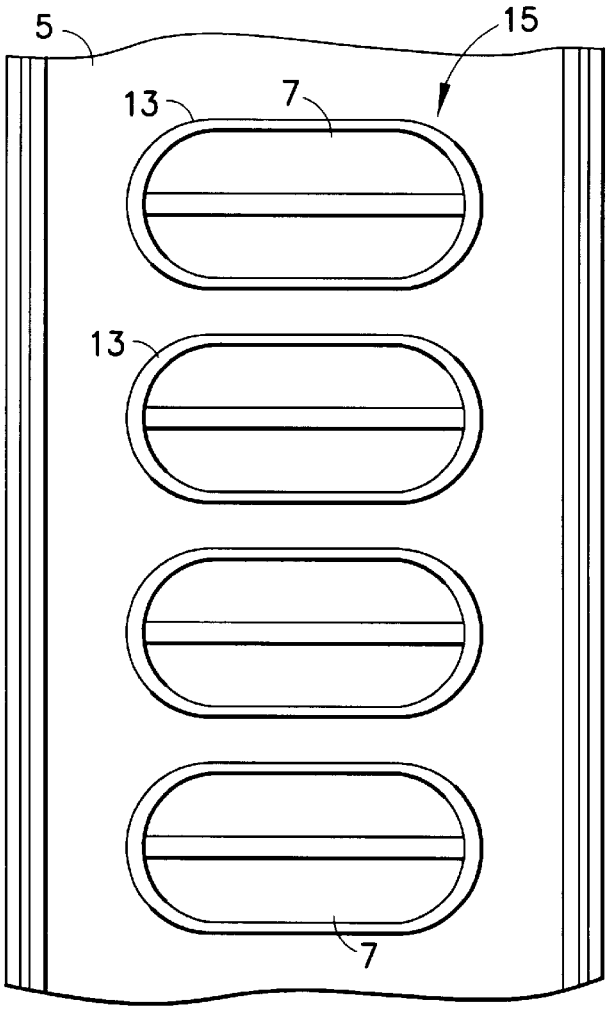

It is pointed out that the invention is not restricted to heat exchangers with two rows of tubes 2. An example of a heat exchanger having a single row of tubes is shown in FIGS. 5*a*–5*b*.

It will be clear to those skilled in the art that the present invention is not limited to the specific embodiments disclosed and illustrated herein. Numerous modifications can be made within the spirit and scope of the invention as defined by the appended claims.

What we claim is:

1. A method of connecting flat tubes to a connection plate in the production of a heat exchanger, comprising:

forming a plurality of holes in the connection plate;

deforming the peripheries of the holes to establish tube-accommodating connecting sleeve elements on one side of the plate;

forming a widened portion of each of the tubes by deforming an end area of each of the tubes into a shape corresponding to that of a first portion of the connecting sleeve element, the widened portion having smaller dimensions than the corresponding connecting sleeve elements;

forming a tubular portion of each of the tubes by deforming an area adjacent to said end area into a shape corresponding to a second portion of said connecting sleeve element;

offsetting the axis of the widened portion of a tube from the axis of the main portion of the tube, so that when the widened portion is inserted into a connecting sleeve element, the main tube portion contacts the main tube portion of an adjacent tube;

inserting the widened portion of the tubes into the connecting sleeve elements; and further widening the widened portion of the tubes so that the respective tube ends are applied against the respective connecting sleeve elements.

2. The method of claim 1, wherein the further widening of the widened portion of the tubes gives the widened portion the shape of truncated cones.

3. The method of claim 1, wherein the end portions of the connecting sleeve elements facing away from the plate are widened before the tubes are inserted in the connecting sleeve elements.

4. The method of claim 1, wherein the end area of the tube is, in the step of deforming an end area of the tube, deformed in such a manner as to increase the width of its opposing narrow sides and displace the one narrow side in the direction of the other narrow side.

5. The method of claim 4, wherein the tubes are mounted on the connection plate in at least two rows, the displaced narrow sides of the tubes in the one row facing the displaced narrow sides of the tubes in the other row.

* * * * *